United States Patent [19]

Kirn

[11] Patent Number: 5,042,207

[45] Date of Patent: Aug. 27, 1991

[54] CLAMPING DEVICE FOR AXIALLY TIGHTENING A TOOL, IN PARTICULAR A DISC

[75] Inventor: Manfred Kirn, Stuttgart, Fed. Rep. of Germany

[73] Assignee: Robert Bosch GmbH, Stuttgart, Fed. Rep. of Germany

[21] Appl. No.: 392,994

[22] PCT Filed: Dec. 4, 1987

[86] PCT No.: PCT/DE87/00571

§ 371 Date: Jul. 24, 1989

§ 102(e) Date: Jul. 24, 1989

[87] PCT Pub. No.: WO88/05366

PCT Pub. Date: Jul. 28, 1988

[30] Foreign Application Priority Data

Jan. 24, 1987 [DE] Fed. Rep. of Germany ..... 3702142

[51] Int. Cl.[5] ..... B24B 41/04

[52] U.S. Cl. ..... 51/168; 51/170 PT

[58] Field of Search ..... 51/168, 170 R, 170 PT, 51/170 T, 206 R, 209 R; 271/1 K, 1 R, 8, 97; 83/666, 678

[56] References Cited

FOREIGN PATENT DOCUMENTS 3012836 9/1985 Fed. Rep. of Germany .

*Primary Examiner*—Maurina Rachuba

*Attorney, Agent, or Firm*—Michael J. Striker

[57] ABSTRACT

The clamping device for portable grinding machines is part of the clamping nut, which can be screwed on the threaded spindle portion of the drive spindle (10) at its free end for tightening a grinding disk. The clamping nut carries a non-rotatable and axially displaceable clamping disk. Both contain annular surfaces (25, 26) which complement one another approximately so as to form a ball groove, and balls serving to support the clamping disk can roll along these annular surfaces. The clamping disk and clamping nut are coupled via coaxial longitudinal pins which simultaneously form ball stops. A ring with a ball groove sits axially between the clamping disk (21) and the clamping nut, and radial pins projecting into the ball track press against the balls via springs. The annular surface of the clamping disk contains ball cut-out portions, the balls penetrating into the ball cut-out portions when the actuating member is rotated accompanied by axial relieving of the clamping disk (FIG. 1).

21 Claims, 3 Drawing Sheets

CLAMPING DEVICE FOR AXIALLY TIGHTENING A TOOL, IN PARTICULAR A DISC

BACKGROUND OF THE INVENTION

1. Prior Art

My invention relates to a clamping device or chuck for axially clamping a tool, especially a disk.

A clamping device for clamping a tool to a flange on a driven spindle is known comprising a clamping nut, which can be screwed on a threaded spindle portion of the spindle on its free end, and a clamping disk which is arranged axially between the tool and the clamping nut, is supported at the clamping nut and can press against the tool and press the latter against the flange. Such clamping devices are chiefly suitable for portable hand-held machine tools and particularly for grinding machines. A clamping device of the aforementioned type is known (DE-PS 30 12 836) in which the clamping disk consists of an element which is approximately hat-shaped in cross section and is supported axially against the flange of the clamping nut via a helical spring. In screwing on and tightening the clamping nut, this clamping disk is pressed axially against the tool via the axially compressed spring, and the tool is accordingly tightened against the flange on the spindle side. The front side of a cylindrical shoulder of the clamping nut comes into immediate contact at a facing axial side of the flange on the spindle side and, if the clamping nut is tightened further, the flange on the spindle side is tightened together with the clamping nut, possibly until the rear flange comes into contact axially at the shoulder surface of the spindle forming the supporting element. It is to be achieved by means of this, in an angle grinder, that the grinding disk is clamped with defined contact pressing pressure and that this contact pressing pressure is ensured. This clamping device is also supposed to make it possible to exchange the grinding disk quickly and simply and simultaneously to prevent an overloading of the hand-held machine tool, particularly the angle grinder. That is, if the torque acting on the grinding disk is too great, the grinding disk stops, while the rear flange and the clamping nut, with the clamping disk, execute a relative movement thereto. This clamping device counters the effect whereby the clamping nut continues to tighten by itself during operation, which would otherwise considerably impede the loosening of the clamping nut when changing the grinding disk. Nevertheless, it is only possible to loosen the clamping nut with the use of a special auxiliary tool, wherein the spindle must be held reciprocally by means of a second auxiliary tool, e.g. a wrench, depending on the design of the machine.

SUMMARY OF THE INVENTION

Accordingly, it is an object of my invention to provide an improved clamping device for axially clamping a tool which may be loosened in a quick and reliable manner for exchange of tools.

It is also an object of my invention to provide an improved clamping device for axially clamping a tool which may be converted without special rebuilding.

In keeping with these objects and with other which will become apparent hereinafter, the clamping disk is coupled with the clamping nut so as to be axially displaceable but fixed with respect to rotation relative to it and is axially supported by a plurality of rolling bodies guided on tracks of the clamping disk and the clamping nut. An actuating member acting on the rolling bodies is arranged between the clamping disk and the clamping nut and presses the rolling bodies against stops of the clamping disk in one direction corresponding to the tightening direction and in the opposite direction moves them along the tracks until at respectively assigned axial and/or radial cut out portions which open into the tracks thus relieving the clamping disk from clamping pressure.

There are several possible embodiments of my invention. Advantageously there are three rolling bodies distributed equidistant circumferentially and the rolling bodies are balls. The actuating member may consist of a ring which is arranged axially between the clamping disk and the clamping nut and is held so as to be rotatable relative thereto and the ring comprises an inner track assigned to the rolling bodies. The tracks may be formed from annular surfaces on the clamping disk, on the clamping nut and on the actuating member having the shape of a circular-arc portion in cross section and adapted to the ball radius of the balls. Together the clamping disk, the clamping nut and the actuating member form a guide groove for the balls in which the balls can roll in the circumferential direction during relative rotation between the actuating member and the clamping disk with the clamping nut.

In the clamping device, according to the invention, with the characterizing features of the main claim, the following advantages result. It is possible to exchange tools without any auxiliary tool, and this can be done in a quick and secure manner. Another advantage consists in that already existing hand-held machine tools can also be converted without special rebuilding. For this purpose, a simple exchange of the existing conventional clamping nut with a completing unit is sufficient, which completing unit comprises a clamping nut with clamping disk and actuating member. In all respects, the clamping nut can be constructed, as before, in a conventional manner, e.g. so as to conform to standards, in the area which is accessible from the outside, so that a wrench can still be applied in particularly tenacious cases, e.g. when the clamping nut is rusted tight, and the clamping nut can be loosened with this auxiliary tool. The same principle used in the clamping device according to the invention can also be used at the rear flange on the spindle side. This flange is then exchanged with the completing unit, which comprises clamping nut with clamping disk and actuating member. The clamping disk is then pressed against the tool at the rear. As directly equivalent to the structure described the main claim, this exchange is likewise to be comprised by that. Advantageous developments and improvements of the clamping device indicated in the main claim are made possible by means of the features indicated in the subclaims.

The complete wording of the claims is not repeated in the following only in order to avoid unnecessary repetition. However, all these features of the claims are to considered as disclosed in this place expressly and as substantial to the invention. All features mentioned in this description and all features which are discernable from the drawing alone are additional component parts of the invention, even if they are not particularly emphasized and not mentioned in the claims.

BRIEF DESCRIPTION OF THE DRAWINGS

An embodiment example of the invention is shown in the drawing and explained in more detail in the following description.

DETAILED DESCRIPTION OF THE INVENTION

Figure 1:
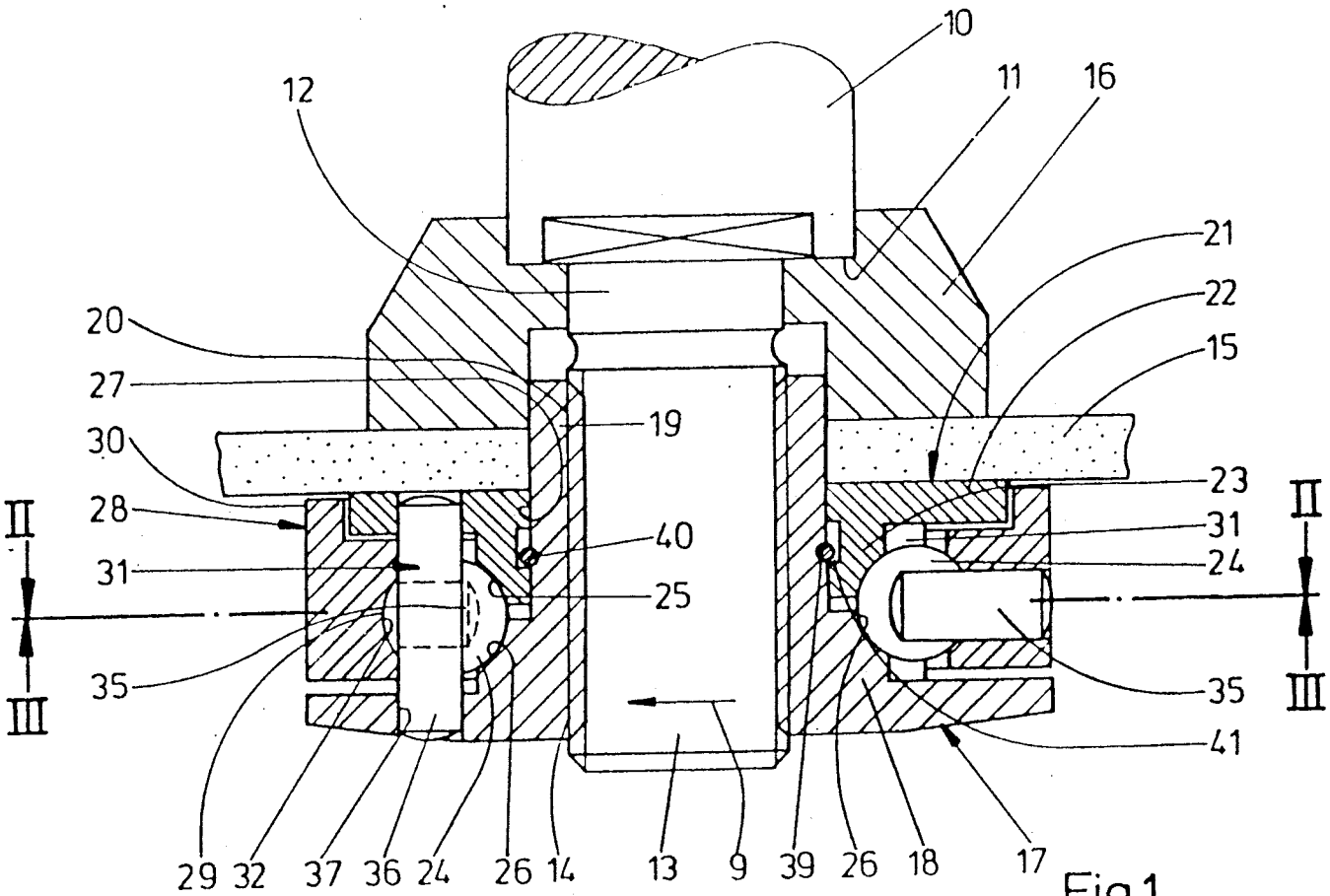
FIG. 1 is a schematic cross sectional view of a clamping device according to my invention which is part of an angle grinder with clamped in grinding disk.

The drawings show the lower part of a portable hand-held machine tool which is constructed e.g. as an angle grinder, and which comprises a spindle 10 which is driven by means of a motor and via a gear unit. The spindle 10 continues in a cylindrical portion 12 of smaller diameter at an annular shoulder 11 and then into a threaded spindle portion at the free end of the spindle. The threaded spindle portion comprises an external thread 14. The spindle 10 serves to drive a tool 15 which comprises e.g. the indicated grinding disk or another tool disk, a rubber plate, or the like. The tool 15 is clamped and tightened between a flange 16 and a clamping member which is part of clamping nut 17 and is explained in more detail in the following. The flange 16 is supported axially at the annular shoulder 11 and is centered radially on the cylindrical portion 12. The flange 16 engages with the spindle 10 in a positive-locking manner so as to be fixed with respect to rotation relative to it by means of shaped surfaces at the spindle 10 and the flange 16, which shaped surfaces, e.g. two flattened portions which are parallel to one another, fit together, the flange 16 being carried along by the spindle 10 in the circumferential direction according to arrow 9 when the motor is switched on so as to be fixed with respect to rotation relative to it. This circumferential direction, according to arrow 9, corresponds to the working direction of the tool 15 in which the latter is driven. In the top view according to FIG. 2, this corresponds to the clockwise direction. The clamping nut 17 comprises a flange 18 and a cylindrical-sleeve-shaped hub 19 proceeding from the latter and is provided with a continuous internal thread 20 in the hub 19, the clamping nut 17 being screwed onto the external thread 14 of the threaded spindle portion 13 by means of this internal thread 20. The tool 15 is centered on the outer circumferential surface of the hub 19 when fastening.

A clamping disk 21, which comprises a clamping plate 22 pressing against the tool 15 and a supporting hub 23, is arranged in the axial area between the tool 15 and the clamping nut 17. The clamping disk 21 can be acted upon by axially directed pressing force proceeding from the clamping nut 17 and is capable of pressing axially against the tool 15 and pressing the latter securely against the axial front side of the flange 16.

The clamping disk 21 is coupled with the clamping nut 17 so as to be axially displaceable but non-rotatable relative to it and is axially supported by means of rolling bodies 24. In the shown embodiment, there are three rolling bodies 24 which are arranged so as to be spaced approximately equidistant circumferentially and are constructed here as balls. These balls 24 are guided on tracks of the clamping disk 21 and of the clamping nut 17 which are concentric relative to the central axis, these tracks are formed in each instance from annular surfaces 25, 26 of the clamping disk 21 and clamping nut 17, respectively, which annular surfaces 25, 26 are shaped in the manner of a circular-arc portion in cross section and extend axially at a distance from one another and, in so doing, have identical radii and are adapted to the spherical radius of the balls 24. The clamping disk 21 is centered with the continuous inner circumferential surface 27 of the hub 23 and of the clamping plate 22 on the outer circumferential surface of the hub 19 and are held and guided so as to be axially movable, at least within limits.

Figure 2:
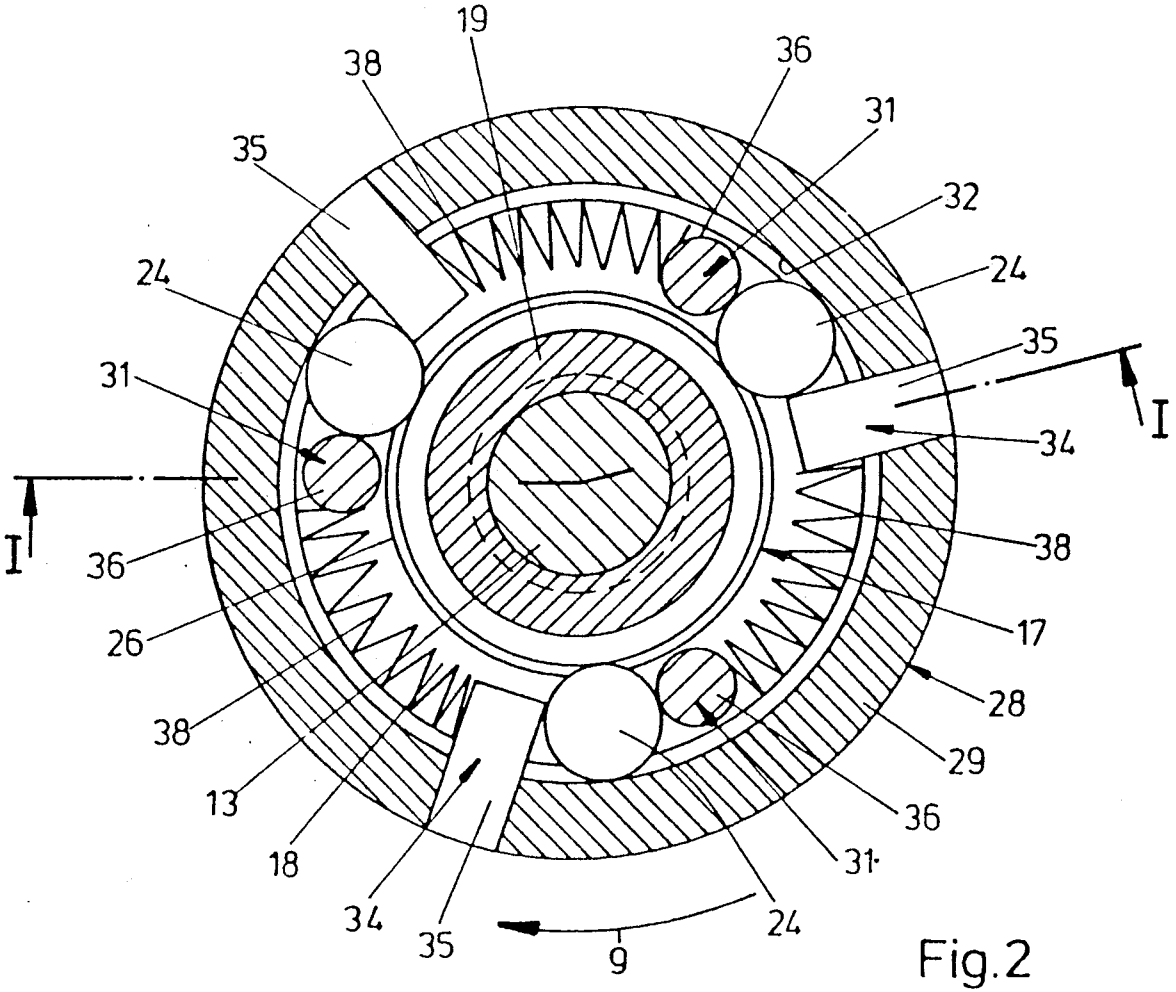
FIGS. 2 and 3 are schematic cross sectional views taken along lines II—II and III—III in FIG. 1.

An actuating member 28 in the form of a ring 29 is arranged between the clamping disk 21 and the clamping nut 17 and overlaps the clamping plate 22 in the axial direction with an upper annular collar 30 in FIG. 1 while leaving clearance for movement by it. The annular collar 30 ends axially at a distance from and, according to FIG. 1, below the end face of the clamping plate 22 contacting the tool 15. The actuating member 28 acts on the balls 24, pressing the latter against stops 31 of the clamping disk 21 in the direction corresponding to the tightening direction, opposite the direction of arrow 9. This clamping state is shown in FIGS. 1 -3.

The ring 29 sits axially with clearance of for movement between the clamping disk 21 and the clamping nut 17 and is held so as to be rotatable relative to both. In its interior, the ring 29 contains an annular surface 32 which is assigned and adapted to the balls 24, is approximately groove-shaped in cross section, and serves as a track for the balls 24, the latter being in contact with the track. This annular surface 32, together with the other annular surfaces 25, 26 of the clamping disk 21 and clamping nut 17, respectively, forms a guide groove for the balls 24 which is adapted to the diameter of the balls 24 and in which the balls 24 can roll in both rotating directions in the circumferential direction during relative rotation between the ring 29 on the one hand and the clamping nut 17 with clamping disk 21 on the other hand, the clamping disk 21 being attached at the clamping nut 17 so as to be fixed with respect to rotation relative to it.

Figure 3:
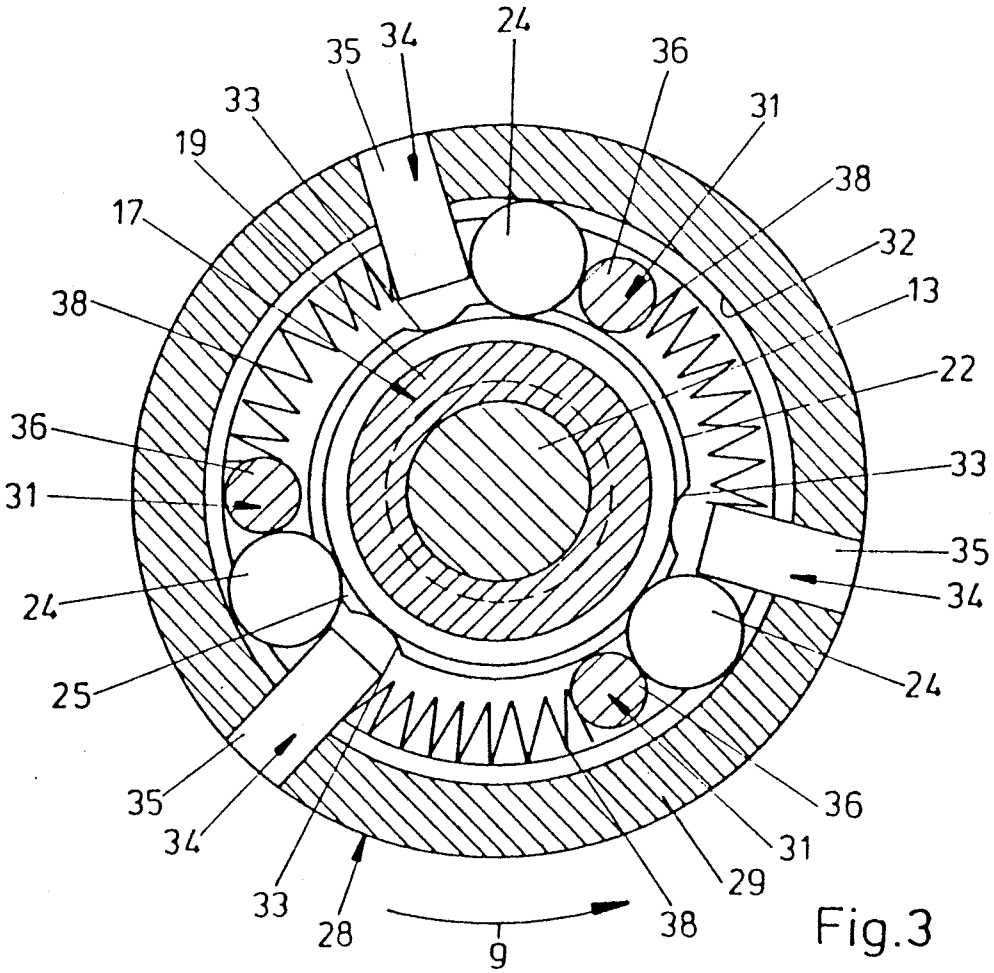

As can be seen from FIG. 3 alone, a cut out portion 33, which is assigned to the ball 24, is contained in the area of the annular surface 25 of the clamping disk 21 for every ball 24, which cut out portion 33 consists in each instance of a recess in this annular surface 25 and is constructed e.g. as a ball pocket which is recessed at least axially at the top in FIG. 1 and opens in the opposite direction of the latter; the ball pocket can also open radially, in addition, and opens into the adjacent area of the annular surface 25 in each instance. Every cut out portion 33 is fashioned such that the balls can penetrate deeper axially in the area of the annular surface 25 of the clamping disk 21 during the rolling of the balls 24 and when the respective assigned cut out portion 33 is reached, so that the axial distance between the clamping disk 21 and the clamping nut 17 is at least slightly reduced, and accordingly the clamping disk 21 is relieved of clamping pressure.

The actuating member 28 is provided, per ball 24, with a fixed driver 34 in the form of a radial pin 35 which is securely attached at the ring 29 and projects radially from the outside to the inside into the track of the respective ball 24 situated in the front at least far enough so that e.g. an approximately tangential contact is effected at the respective ball 24 situated in the front.

The stops 31 of the clamping disk 21 are formed from approximately coaxial longitudinal pins 36 which are securely arranged at the clamping disk 21 and extend up to bore holes 37 in the clamping nut 17 in which they engage e.g. with sliding clearance. In so doing, the longitudinal pins 36 engage approximately coaxially through the guide groove for the balls 24, which is formed by the annular surfaces 25, 26 and 32 together and in such that there is still sufficient intermediate space between the inner surface of the ring 29 and the longitudinal pins 36, so that the latter do not rub against the actuating member 28 in an abrasive manner during the relative rotation between the actuating member 28 on the one hand and the clamping nut 17, with the clamping disk 21, on the other hand. Because of this design, the longitudinal pins 36 are constructed simultaneously for the positive-locking connection of the clamping disk 21 with the clamping nut 17 in the circumferential direction. The stops 31 in the form of these longitudinal pins 36 are located in each instance on the other side of the respective assigned ball 24, which side is located opposite the radial pin 35 for every ball 24. In the clamping position shown in FIGS. 1–3, with the tool 15 tightened and the motor turned on, the clamping disk 21 is also carried along in the working direction according to arrow 9 via the clamping force and friction, as is clamping nut 17 via the longitudinal pins 36.

In so doing, the longitudinal pins 36 abut in the direction of arrow 9 at the respective balls 24 which are situated in front and which press against the respective radial pins 35 of the actuating member 28 which are situated in front. The actuating member 28 is spring-loaded in the opposite direction of the circumferential direction according to arrow 9, which simultaneously corresponds to the loosening direction. This is achieved by means of respective cylindrical helical springs 38 which are placed inside the guide groove formed by the annular surfaces 25, 26 and 32 and act in the circumferential direction. Every helical spring 38 is arranged in the circumferential area between a longitudinal pin 36 and a radial pin 35 and is supported at the latter on the end side. The actuating member 28 is acted upon in a resiliently elastic manner by means of these helical springs 38 relative to the clamping nut 17 with clamping disk 21 in the opposite direction of arrow 9 in such a way that the respective radial pin 35 presses the ball 24 situated in front, respectively, in the direction opposite the arrow 9 against the longitudinal pin 36 situated in front. The actuating member 28 is accordingly held via the helical springs 38 in the clamping position shown in FIGS. 1–3 relative to the clamping nut 17 with clamping disk 21.

The clamping disk 21 is secured at the clamping nut 17 while allowing at least slight axial movement. A spring ring 39 is used for this purpose, which spring ring 39 is received in a groove 40 on the outer circumferential surface of the hub 19 of the clamping nut 17 in a substantially accurate fit, specifically in such a way that the spring ring 39 penetrates into the groove 40 e.g. with half its cross section, while the other half of its cross section projects up radially. The clamping disk 21 contains, on the inner circumferential surface 27 of the hub 23, a groove 41 which is assigned to the spring ring 39; however, the groove 41 has a greater axial width than the spring ring 39 and the groove 40. The radially measured depth of the groove 41 corresponds approximately to the other half of the cross section of the spring ring 39. It is not shown in detailed in the drawings but the flanks of the groove 40 and/or 41 can be beveled so as to enable a slight sliding together and subsequent loosening of the clamping disk 21 and clamping nut 17 in the axial direction.

Sealing elements e.g. foam-rubber rings, which are not shown in more detail, can be arranged in the intermediate spaces between the ring 29 and the clamping disk 21 on one of the axial sides of the ring 29 and between the ring 29 and the flange 18 of the clamping nut 17 on its other axial side. These sealing elements ensure a sealing against the penetration of dirt, e.g. grinding dust, or the like. The sealing elements are inserted during assembly.

FIGS. 1–3 show the described clamping device in the clamping position in which the tool 15 is tightened axially at the flange 16 via the clamping disk 21, axially supported via the balls 24 at the clamping nut 17.

If the tool 15 is removed and exchanged, the flange 16 and/or the tool 15 is blocked with respect to rotation via suitable means; this can be effected e.g. by means of a spindle locking device integrated in the hand-held machine tool. Under certain circumstances, the friction in the gear possibly also hinders the spindle 10 from rotating in the direction of the arrow 9, at least within limits. To loosen, the actuating member 28 is then rotated by hand in the working direction according to arrow 9, wherein the radial pins 35 are moved from the balls 24 and, accompanied by compression of the helical springs 38, moved in the circumferential direction in the direction of the longitudinal pins 36 of the clamping disk 21 with clamping nut 17, the clamping disk 21 does not rotate relative to it. During this movement, the balls 24 roll on the tracks formed by means of the annular surfaces 25, 26 and 32, wherein the balls 24 likewise migrate in the circumferential direction according to arrow 9. As soon as the balls 24 have reached the cut out portions 33 in the annular surface 25 of the clamping disk 21 during this movement, the balls 24 penetrate axially into these cut out portions 33. In this position, the clamping disk 21 can deflect axially relative to the clamping pressure, i.e., in the view of FIG. 1, axially at least slightly in the direction of the clamping nut 17, and can displace the ring 29 at least far enough so that a corresponding axial relieving can be achieved. Thereupon, the completing unit, consisting of clamping nut 17 with clamping disk 21 and actuating member 28, can easily be completely screwed off by hand. The relative swiveling movement of the actuating member 28 for relieving the clamping disk 21 axially is limited in that the radial pins 35 abut at the longitudinal pins 36 when the helical springs 38 are entirely compressed. As soon as the axial relieving is effected and the completing unit can easily be completely screwed off by hand, the repositioning of the balls 24 is effected automatically because of the relaxing helical springs 38. The actuating member 28 is turned back again, relative to the clamping nut 17 with clamping disk 21, into the initial position shown in FIGS. 1–3 by means of the spring pressure on the radial pins 35, wherein, by means of the rolling movement of the balls 24, the balls 24 are moved out of the cut out portions 33 again and moved back into the shown position. In this position, the completing unit, consisting of clamping nut 17 with clamping disk 21 and actuating member 28, is ready for tightening a new inserted tool. For this purpose, it is sufficient to tighten this completing unit slightly opposite the direction of arrow 9 when screwing on the threaded spindle portion and accordingly slightly tightening the new tool 15, since the tool 15 tightens by itself in operation when the motor is subsequently switched on.

Thanks to the balls 24 the friction effected during the relative rotation of clamping disk 21 between the actuating member 28 and the clamping nut 17, is a rolling friction which is accordingly practically negligibly small.

The described clamping device is simple, inexpensive and quick, secure and easy to handle. It makes it possible to exchange the tool 10 rapidly and securely without requiring additional special tools for this purpose. Another advantage consists in that already existing hand-held machine tools, particularly grinding machines, can also be equipped with this clamping device subsequently without special rebuilding. For this purpose, its conventional clamping nut need only be replaced by the completing unit consisting of clamping nut 17 with clamping disk 21 and actuating member 28. Moreover, the clamping nut 17 can be constructed in such a way that it also enables, if necessary, the application of a special tool, e.g. in the form of a two-hole nut wrench, as was possible previously, so that the clamping nut 17 and, accordingly, the entire completing unit can also still be loosened in a conventional manner by means of such an auxiliary tool in particularly tenacious cases, e.g. in the rusted state. The clamping device is not limited to a grinding disk as tool 15. On the contrary, such tools as clamping disks, brushes, rubber plates, and the like, can also be clamped in the same manner without the use of tools.

It will be understood that each of the elements described above, or two or more together, may also find a useful application in other types of structures differing from the types described above.

While the invention has been illustrated and described as embodied in a clamping device for axially clamping a tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of the prior art, fairy constitute essential characteristics of the generic or specific aspects of this invention.

What is claimed as new and desired to be protected by Letters Patent is set forth in the appended claims.

1. In a clamping device for clamping a tool, especially a disk, to a flange on a driven spindle having a threaded spindle portion at a free end thereof, comprising a clamping nut, which is screwable on said threaded spindle portion, and a clamping disk, which is arranged axially between said tool and said clamping nut, is supported on said clamping nut and is pressible against said tool to press said tool against said flange, the improvement wherein said clamping disk has a plurality of stops and is coupled with said clamping nut so as to be axially displaceable but fixable with respect to rotation relative to said clamping nut and has a plurality of circumferential tracks and a plurality of cut out portions which open into said tracks, and said clamping device further comprises a plurality of rolling bodies guided on said tracks of said clamping disk and said clamping nut to support said clamping disk axially and an actuating member arranged between said clamping disk and said clamping nut which acts on said rolling bodies and presses said rolling bodies against said stops of said clamping disk in one circumferential direction corresponding to a tightening direction and moves said rolling bodies in an opposite circumferential direction along said tracks until at assigned ones of said cut out portions which open into said tracks to relieve said clamping disk from clamping pressure.

2. The improvement according to claim 1, wherein three of said rolling bodies are provided and are arranged so as to be approximately equidistant circumferentially.

3. The improvement according to claim 1, wherein each of said rolling bodies is a ball.

4. The improvement according to claim 1, wherein said actuating member includes a ring which is arranged axially between said clamping disk and said clamping nut and is held so as to be rotatable, and said ring comprises an inner track assigned to said rolling bodies which contact on said track.

5. The improvement according to claim 3, wherein said tracks are formed from a plurality of annular surfaces in said clamping disk, in said clamping nut and in said actuating member, said annular surfaces having a circular-arc portion in cross section adapted to fit said balls to that, together, said clamping disk, said clamping nut and said actuating member form a guide groove for said balls, in which said balls can roll in one of said circumferential direction during relative rotation between said actuating member and said clamping disk with said clamping nut.

6. The improvement according to claim 1, wherein said clamping disk has an annular surface and said cut out portions are provided as recesses in said annular surface.

7. The improvement according to claim 6, wherein said rolling bodies comprise balls and said recesses are structured as axial ball pockets which open radially exteriorly and in which said balls can deflect during rolling as a result of rotation of said actuating member in said circumferential direction so that said clamping disk is relieved and loosened to provide axial displacement of said clamping disk.

8. A clamping device for clamping a tool, especially a disk, to a flange on a driven spindle having a threaded spindle portion at a free end thereof, comprising a clamping nut, which is screwable on said threaded spindle portion, and a clamping disk, which is arranged axially between said tool and said clamping nut, is supported on said clamping nut and is pressible against said tool to press said tool against said flange, said clamping disk having a plurality of stops and being coupled with said clamping nut so as to be axially displaceable but fixable with respect to rotation relative to said clamping nut, and said clamping disk and said clamping nut also having a plurality of circumferential tracks, and a plurality of cut out portions which open into said tracks are provided, and further comprising a plurality of rolling bodies guided on said tracks of said clamping disk and said clamping nut to support said clamping disk axially and an actuating member arranged between said clamping disk and said clamping nut which acts on said rolling bodies and presses said rolling bodies against said stops of said clamping disk in one circumferential direction corresponding to a tightening direction and moves said rolling bodies in an opposite circumferential direction along said tracks until at assigned ones of said cut out portions which open into said tracks to relieve said clamping disk from clamping pressure, and wherein said actuating member is spring-loaded in said circumferential direction opposite to said one of said circumferential directions in which said actuating member is rotated to provide relief of said clamping disk.

9. The improvement according to claim 1, wherein said actuating member comprises a stationary driver for each of said rolling bodies, said stationary driver projecting into said track of said rolling body and abutting on said rolling body in one direction.

10. The improvement according to claim 1, wherein said clamping disk comprises one of said stops which penetrates said track transversely for each of said rolling bodies, said rolling body abutting on said stop in one of said circumferential directions.

11. A clamping device for clamping a tool, especially a disk, to a flange on a driven spindle having a threaded spindle portion at a free end thereof, comprising a clamping nut, which is screwable on said threaded spindle portion, and a clamping disk, which is arranged axially between said tool and said clamping nut, is supported on said clamping nut and is pressible against said tool to press said tool against said flange, said clamping disk having a plurality of stops and being coupled with said clamping nut so as to be axially displaceable but fixable with respect to rotation relative to said clamping nut, and said clamping disk and said clamping nut also having a plurality of circumferential tracks, and a plurality of cut out portions which open into said tracks are provided, and further comprising a plurality of rolling bodies guided on said tracks of said clamping disk and said clamping nut to support said clamping disk axially and an actuating member arranged between said clamping disk and said clamping nut which acts on said rolling bodies and presses said rolling bodies against said stops of said clamping disk in one circumferential direction corresponding to a tightening direction and moves said rolling bodies in an opposite circumferential direction along said tracks until at assigned ones of said cut out portions which open into said tracks to relieve said clamping disk from clamping pressure, said actuating member comprising a stationary driver for each of said rolling bodies, said stationary driver projecting into said track of said rolling body and abutting on said rolling body in one direction, and wherein said driver is formed as a radial pin.

12. A clamping device for clamping a tool, especially a disk, to a flange on a driven spindle having a threaded spindle portion at a free end thereof, comprising a clamping nut, which is screwable on said threaded spindle portion, and a clamping disk, which is arranged axially between said tool and clamping nut, is supported on said clamping nut and is pressible against said tool to press said tool against said flange, said clamping disk having a plurality of stops and being coupled with said clamping nut so as to be axially displaceable but fixable with respect to rotation relative to said clamping nut and said clamping disk and said clamping nut also having a plurality of circumferential tracks, and a plurality of cut out portions which open into said tracks are provided, and further comprising a plurality of rolling bodies guided on said tracks of said clamping disk and said clamping nut to support said clamping disk axially and an actuating member arranged between said clamping disk and said clamping nut which acts on said rolling bodies and presses said rolling bodies against said stops of said clamping disk in one circumferential direction corresponding to a tightening direction and moves said rolling bodies in an opposite circumferential direction along said tracks until at assigned ones of said cut out portions which open into said tracks to relieve said clamping disk from clamping pressure, said actuating member comprising a stationary driver for each of said rolling bodies, said stationary driver projecting into said track of said rolling body and abutting on said rolling body in one direction, and further comprising a spring arranged in one circumferential area, as view in one of said circumferential directions corresponding to said tightening direction, between one of said stops and one of said drivers and supported by both said stop and said driver and acts circumferentially, said actuating member being acted upon in said circumferential direction by said spring relative to said clamping nut and said clamping disk so that said driver presses said rolling bodies against said stop, said rolling body being positioned between said spring and said stop.

13. The improvement according to claim 12, wherein said stop comprises a longitudinal pin and said driver comprises a radial pin.

14. The improvement according to claim 1, wherein said clamping disk has an inner circumferential surface and said clamping nut has a cylindrical-sleeve-shaped hub positionable adjacent said inner circumferential surface, said clamping disk with said inner circumferential surface being centered on said cylindrical-sleeve-shaped hub of said clamping nut and held and guided so as to be axially movable to a limited extend.

15. A clamping device for clamping a tool, especially a disk, to a flange on a driven spindle having a threaded spindle portion at a free end thereof, comprising a clamping nut, which is screwable on said threaded spindle portion, and a clamping disk, which is arranged axially between said tool and said clamping nut, is supported on said clamping nut and is pressible against said tool to press said tool against said flange, said clamping disk having a plurality of stops and being coupled with said clamping nut so as to be axially displaceable but fixable with respect to rotation relative to said clamping nut and said clamping disk and said clamping nut also having a plurality of circumferential tracks, and a plurality of cut out portions which open into said tracks are provided, and further comprising a plurality of rolling bodies guided on said tracks of said clamping disk and said clamping nut to support said clamping disk axially and an actuating member arranged between said clamping disk and said clamping nut which acts on said rolling bodies and presses said rolling bodies against said stops of said clamping disk in one circumferential direction corresponding to a tightening direction and moves said rolling bodies in an opposite circumferential direction along said tracks until at assigned ones of said cut out portions which open into said tracks to relieve said clamping disk from clamping pressure, and wherein said clamping disk has an inner circumferential surface and said clamping nut has a cylindrical-sleeve-shaped hub positionable adjacent said inner circumferential surface, said clamping disk with said inner circumferential surface being centered on said cylindrical-sleeve-shaped hub of said clamping nut and held and guided so as to be axially movable to a limited extent and further comprising a spring ring located in adjacent annular grooves of said clamping nut and said clamping disk, said spring ring engaging in one of said grooves in a positive-locking manner, and one of said grooves has an axial width greater than that of said spring ring.

16. The improvement according to claim 15, wherein said groove receives said spring ring in an approximately accurate fit and is provided in an outer circumferential surface of said hub and another of said grooves having a greater axial width is arranged in an inner circumferential surface of said clamping disk.

17. The improvement according to claim 11, wherein said stops of said clamping disk are simultaneously structured for positive-locking connection of said clamping disk with said clamping nut.

18. The improvement according to claim 17, wherein said stops comprise longitudinal pins.

19. The improvement according to claim 17, wherein said clamping nut is provided with a bore hole and each of said stops is arranged so as to be fixed on said clamping disk and extends up to said bore hole in said clamping nut in which said stop engages with sliding clearance.

20. The improvement according to claim 1, wherein each of said cut out portions is an axially-extending portion.

21. The improvement according to claim 1, wherein each of said cut out portions is a radially-extending portion.

* * * * *